US005613373A

United States Patent [19]

Grenier

[11] Patent Number: 5,613,373

[45] Date of Patent: Mar. 25, 1997

[54] PROCESS AND APPARATUS FOR COOLING A FLUID ESPECIALLY FOR LIQUIFYING NATURAL GAS

[75] Inventor: Maurice Grenier, Paris, France

[73] Assignee: Gaz de France (Service National), Paris, France

[21] Appl. No.: 644,484

[22] Filed: May 10, 1996

Related U.S. Application Data

[63] Continuation of Ser. No. 347,365, Dec. 2, 1994, Pat. No. 5,535,594.

[51] Int. Cl.[6] ..... F25J 3/00

[52] U.S. Cl. ..... 62/612; 62/627; 62/903; 165/166

[58] Field of Search ..... 62/612, 627, 903; 165/166

[56] References Cited

U.S. PATENT DOCUMENTS

| | | | |
|---|---|---|---|
| 3,747,359 | 7/1973 | Streich | 62/24 |
| 4,274,849 | 6/1981 | Garier et al. | 62/9 |
| 4,334,902 | 6/1982 | Paradowski | 62/9 |
| 4,339,253 | 7/1982 | Caetani et al. | 62/9 |
| 4,586,942 | 5/1986 | Gauthier | 62/28 |
| 4,809,154 | 2/1989 | Newton | 62/9 |

FOREIGN PATENT DOCUMENTS

| | | |
|---|---|---|
| 0117793 | 9/1984 | European Pat. Off. . |
| 0500355 | 8/1992 | European Pat. Off. . |

*Primary Examiner*—Ronald C. Capossela
*Attorney, Agent, or Firm*—Rothwell, Figg, Ernst & Kurz

[57] ABSTRACT

In this process, which incorporates an integral cascade, the coolant mixture issuing from the penultimate stage (1B) of the compressor cycle (1) is delivered to a distillation apparatus (5) the head vapor of which is cooled (in 24) to a temperature significantly lower than the ambient temperature, then separated into two phases (in 6C); the vapor stage is supplied to the last stage (1C) of the compressor, and the liquid phase constitutes a coolant fluid for the hot part (8) of the heat exchange line (7).

40 Claims, 4 Drawing Sheets

PROCESS AND APPARATUS FOR COOLING A FLUID ESPECIALLY FOR LIQUIFYING NATURAL GAS

This is a continuation of application Ser. No. 08/347,365, filed Dec. 2, 1994 now U.S. Pat. No. 5,535,594.

BACKGROUND OF THE INVENTION

The present invention relates to the cooling of fluids, and applies particularly to the liquifying of natural gas. It concerns in the first place a process for cooling a fluid, especially for liquifying natural gas, of the incorporated integral cascade type, in which a coolant mixture composed of constituents of different volatilities is compressed in at least two stages and after at least each of the intermediate compression stages the mixture is partially condensed, at least some of the condensed fractions, as well as the high pressure gas fraction being cooled, then being depressurised, put into a heat exchange relation with the fluid to be cooled, and then compressed again.

The pressures dealt with below are absolute pressures.

The liquifying of natural gas using a cooling cycle called "incorporated cascade" utilising a mixture of liquids has long been proposed.

The coolant mixture is constituted by a certain number of fluids which include, among others, nitrogen and hydrocarbons such as methane, ethylene, ethane, propane, butane, pentane, etc.

The mixture is compressed, liquified then supercooled at the high pressure of the cycle which generally lies between 20 and 50 bars. This liquifying can be put into effect in one or several stages with the condensed liquid being separated at each stage.

SUMMARY OF THE INVENTION

The liquid or liquids obtained is or are, after supercooling, depressurised to the low pressure of the cycle, generally lying between 1.5 and 6 bars, and vaporised in counter current with the natural gas to be liquified and the cycle gas to be cooled.

After reheating to about ambient temperature, the coolant mixture is once again compressed to the high pressure of the cycle.

For the operation to be possible it is necessary to have available a fluid capable of condensing at ambient temperature at the high pressure of the cycle. This poses a particular difficulty because the mixture and the pressures are generally optimized for the cold part of the liquifying installation and do not lend themselves well to a cooling which performs equally well in the hot part, that is to say lying between the ambient temperature (generally of the order of +30° C. to +40° C. in natural gas production regions) and an intermediate temperature of the order of −20° C. to −40° C.

Thus numerous existing installations require for the hot part, a separate cooling cycle of propane or a propane-ethane mixture. Thus a relatively low consumption of specific energy is obtained, but at the price of a large increase in the complexity and cost of the installation.

The object of the invention is to eliminate the separate cooling cycle, and thus to utilise a single compressor group, that is to say a so-called "integral incorporated cascade" cooling cycle, in such a way as to permit a specific energy of the process to be obtained with, at the same time, a relatively reduced investment.

To this effect, the object of the invention is a cooling process of the type mentioned above, characterised in that the gas issuing from the penultimate compression stage is distilled in a distillation apparatus the head of which is cooled with a liquid having a temperature significantly lower than the ambient temperature, in order to form on one hand the condensate of this penultimate stage, and on the other hand a vapour phase which is delivered to the last compression stage.

In the interests of clarity, the "ambient temperature" will be defined as the thermodynamic reference temperature corresponding to the temperature of the cooling fluid (notably water) available on the site and utilised in the cycle, increased by the temperature difference, fixed by construction, at the exit of the machinery of the cooling apparatus (compressors, heat exchangers, etc.). In practice, this difference is in the region of 3° C. to 10° C., and preferably of the order of 5° to 8° C.

It will henceforth equally be noted that the cooling temperature at the head of the distillation apparatus (corresponding approximately to the temperature of the "liquid" acting to this effect) will be between about 0° C. and 20° C., and generally between 5° C. and 15° C., for an "ambient temperature" (or entry temperature into the heat exchange line) of the order of 15° C. to 45° C., and generally between 30° C. and 40° C.

Moreover, the process may comprise one or several of the following characteristics:

The cooling and partial condensing of the head vapour of the distillation apparatus by exchange of heat with at least the said depressurised fractions, and the cooling of the head of the distillation apparatus with the liquid phase thus obtained;

The cooling and partial condensing in the region of the ambient temperature of the gas issuing from the last compression stage, the depressurising of the liquid phase thus obtained and the cooling of the head of the distillation apparatus by means of this depressurised liquid phase;

Dephlegmation of the gas coming from the last compression stage during cooling;

Indirect exchange of heat between the liquid resulting from the cooling of the gas coming from the last compression stage and the head vapour of the distillation apparatus before sending this vapour to the last compression stage and depressurising the said liquid;

Pumping at least one part of the condensate from the first compression stage to the delivery pressure of the second compression stage, and mixing it with the gas coming from this second compression stage;

When the process is intended to liquify natural gas containing nitrogen, the liquified natural gas resulting from the cooling, after being de-nitrogenised, is supercooled by the exchange of heat with the liquified natural gas which has been depressurised but not de-nitrogenised;

When the process is intended for liquifying natural gas containing nitrogen, a preliminary de-nitrogenisation of the natural gas at its processing pressure in an auxiliary column is effected, one part of the liquified natural gas having undergone this preliminary de-nitrogenisation is depressurised to an intermediate pressure, the liquid thus depressurised by cooling the head of the auxiliary column is vaporised, which produces a combustible gas at the intermediate pressure, this combustible gas is sent to a gas turbine which drives the compressor, and the rest of the liquified natural gas having undergone preliminary de-nitrogenisation as well as the head vapour of the auxiliary column is treated in a final de-nitrogenisation column under low pressure producing the de-nitrogenised liquified natural gas to be stored in a container.

The invention also has as its object a fluid cooling installation, notably for liquifying natural gas, designed for putting this process into practice.

This installation, including a cooling circuit of integral incorporated cascade type, in which circulates a coolant mixture and which includes a compressor of at least two stages at least the intermediate stages of which are each provided with a coolant and a heat exchange line, is characterised in that it includes a distillation apparatus fed by the penultimate stage of the compressor and the head of which is connected to the suction of the last stage of the compressor, and means for cooling the head of the distillation apparatus by means of a liquid having a temperature significantly lower than the ambient temperature.

In one particular embodiment the heat exchange line is constituted by two plate exchangers of the same length in series, connected to one another by end domes and possibly welded together end-to-end.

Exemplary embodiments of the invention will now be described with reference to the attached drawings, in which:

DETAILED DESCRIPTION OF THE DRAWINGS

Figure 1:
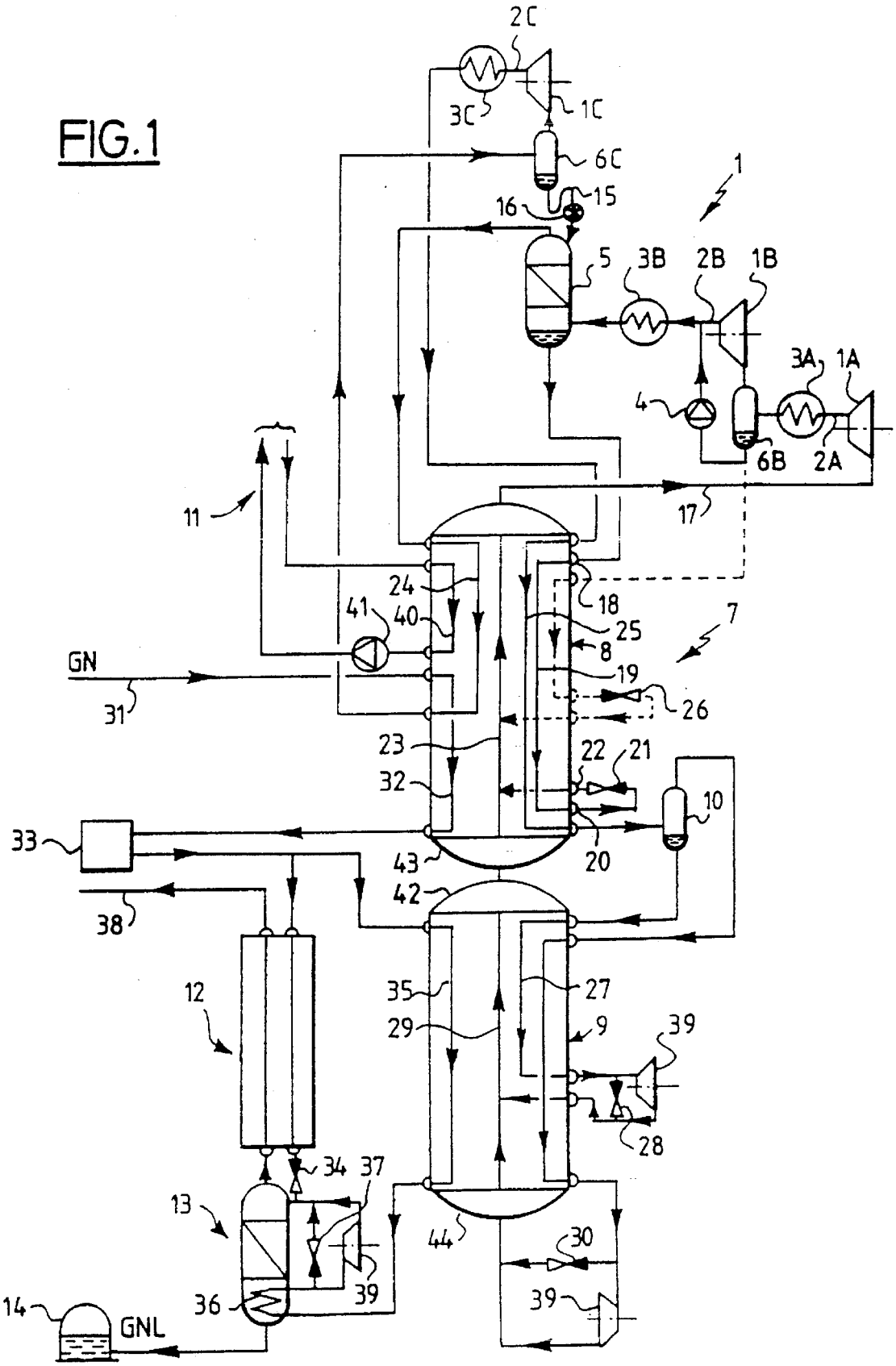
FIG. 1 schematically represents a natural gas liquifying installation in accordance with the invention.

The natural gas liquifying installation shown in FIG. 1 comprises essentially: a single compressor cycle 1 in three stages 1A, 1B and 1C, each stage leading via a respective conduit 2A, 2B and 2C, into a respective cooler 3A, 3B and 3C cooled by sea water, this water typically having a temperature of the order of +25° to +35° C.; a pump 4; a distillation column 5 having several virtual trays; separation vessels 6B, 6C the tops of which communicate respectively with the suction of the stages 1B and 1C; a heat exchange line 7 comprising two heat exchangers in series, namely a "hot" exchanger 8 and a "cold" exchanger 9; an intermediate separation vessel 10; an auxiliary cooling liquid circuit 11; an auxiliary heat exchanger 12; a de-nitrogenisation column 13; and a store of liquified natural gas (LNG) 14.

The outlet of the cooler 3A leads into the separator 6B, the bottom of which is connected to the suction of the pump 4, which leads into the conduit 2B. The outlet of the cooler 3B communicates with the container of the column 5, and the bottom of the separator 6C is connected by gravity via a syphon 15 and a regulator valve 16, to the head of the column 5.

The heat exchangers 8, 9 are rectangular exchangers with aluminium plates, possibly brazed, with a counter current flow of fluids in heat exchange relation, and have the same length. Each has the necessary ducts to ensure the operation which will be described herein, below.

The coolant mixture constituted by C1 to C5 hydrocarbons and nitrogen, exits from the top (hot end) of the heat exchanger 8 in a gaseous state and arrives via a conduit 17 at the suction of the first compressor stage 1A.

It is thus compressed to a first intermediate pressure P1, typically of the order of 8 to 12 bar, then cooled to the region of +30° to +40° C. in 3A and separated into two phases in the container 6B. The vapour phase is compressed to a second intermediate pressure P2, typically of the order of 14 to 20 bars, in 1B, whilst the liquid phase is taken by the pump 4 to the same pressure P2 and introduced into the conduit 2B. The mixture of the two phases is cooled and partially condensed in 3B, then distilled in 5.

The liquid in column 5 constitutes a first coolant liquid, adapted to ensure the main part of the cooling in the hot exchanger 8. For this purpose this liquid is introduced laterally, via an inlet 18, into the upper part of this exchanger, supercooled in ducts 19 while flowing to the cold end of the exchanger, to the region of −20° to −40° C., passed out laterally via an outlet 20, depressurised to the low pressure of the cycle, which is typically of the order of 2.5 to 3.5 bars, in a depressurisation valve 21, and reintroduced in diphasic form at the cold end of the same heat exchanger via an inlet 22 and an appropriate distribution device, to be vaporised in the low pressure ducts 23 of the heat exchanger.

The head vapour of the column 5 is cooled and partially condensed in ducts 24 of the heat exchanger 8 to an intermediate temperature markedly Lower than the ambient temperature, for example to +5° to +10° C., then introduced into the container 6C. The liquid phase flows as a return flow back by gravity, via the syphon 15 and the valve 16, to the head of the column 5, whilst the vapour phase is compressed to the high pressure of the cycle, typically of the order of 40 bars, in 1C, then is returned in the region of +30° to +40° C. in 3C. This vapour phase is then cooled from the hot end to the cold end of the heat exchanger 8 in high pressure ducts 25, and separated into two phases in 10.

To complete the cooling of the exchanger 8 it is possible as represented by a broken line, to supercool to an intermediate temperature part of the liquid collected in 6B, then withdraw it laterally from the exchanger, depressurise it to the low pressure in a depressurisation valve 26, and reintroduce it laterally into the exchanger to vaporise it in the intermediate part of the low pressure ducts 23.

The cooling of the heat exchanger 9 is obtained by means of fluid at high pressure, in the following manner.

The liquid collected in 10 is supercooled in the hot part of the exchanger 9, in ducts 27, then withdrawn from the exchanger, depressurised to low pressure at a depressurisation valve 28, reintroduced into the exchanger and vaporised in the hot part of the low pressure ducts 29 of the latter. The vapour phase issuing from the separator 10 is cooled, condensed and supercooled from the hot end to the cold end of the exchanger 9, and the liquid thus obtained is depressurised to the low pressure in a depressurisation valve 30, and reintroduced at the cold end of the exchanger to be vaporised in the cold part of the low pressure ducts 29, then reunited with the depressurised fluid in 28.

The treated natural gas, in the region of +20° C. after drying, via a conduit 31, is introduced laterally into the heat exchanger 8 and cooled in passing to the cold end of the latter in ducts 32.

At this temperature, the natural gas is delivered to apparatus 33 for the elimination of C2 to C5 hydrocarbons, and the mixture that remains, constituted essentially of methane and nitrogen, with a small quantity of ethane and propane, is divided into two streams: a first stream, cooled, liquified and supercooled from the hot end to the cold end of the auxiliary exchanger 12, then depressurised to the region of 1.2 bar at a depressurisation valve 34, and a second stream, cooled, liquified and supercooled from the hot end to the cold end of the exchanger 9 in ducts 35, supercooled once again from about 8° to 10° C. in a coil 36 forming a distillation vessel of the column 13, and depressurised to the region of 1.2 bar in a depressurisation valve 37. The two pressurised streams are reunited then introduced as a return flow at the head of the column 13, which thus assures the de-nitrogenisation of the natural gas. The liquid in this column constitutes the de-nitrogenised LNG produced by the installation and is delivered to the storage container 14, whilst the head vapour is reheated from −20° to −40° C. in passing from the cold end to the hot end of the exchanger 12 and is delivered via a conduit 38 to the "fuel gas" reservoir to be burned or utilised in a gas turbine of the installation serving to drive the compressor 1.

It is to be noted that a supplementary cut can be made to the natural gas in the exchanger 9 at a temperature permitting the recovery of additional quantities of C2 and C3 hydrocarbons in the apparatus 33.

As has been shown, taking into account the very considerable output usually achieved in such an installation, it could be desirable to depressurise part of the cold liquids in liquid turbines or "expanders" 39 for cooling as well as producing part of the electrical current necessary. In addition the hottest part of the exchanger 8 can be used to cool an appropriate liquid notably pentane from approximately +40° to +20° C. circulated in ducts 40 of the exchanger by a pump 41 and serving to cool another part of the installation, for example the raw natural gas destined to be dried before processing in the liquifying installation. This circulation of liquid constitutes the cooling circuit 11 cited above.

The equipment described above permits at the same time acceleration of the condensation of the mixture issuing from the second compression stage 1B, thanks to the injection of liquid into the conduit 2B by means of the pump 4, and simplification of the exchanger 8 if the entirety of the liquid in the container 6B is pumped, and also allows a high pressure mixture sufficiently free of heavy components to be obtained. More precisely, in the example considered, almost all of the C5 hydrocarbons and the majority of the C4 hydrocarbons may be totally vaporised at the hot end of the ducts 29 of the cold exchanger 9. This presents the important advantage that the ducts can lead into an upper dome 42 of the exchanger 9 communicating directly with a lower dome 43 of the exchanger 8, without any diphasic redistribution being necessary at the cut between the two exchangers; the installation can be further simplified by welding the two exchangers 8 and 9 end to end.

It can also be noted that the suction of the compressor stage 1C at a relatively cool temperature is favourable to the performance of the latter. The cut in the region of −20° to −40° C. approximately between the two exchangers corresponds moreover to heat exchange surfaces of the same order adore and below this division, so that two exchangers 8 and 9 of maximum length can be used in optimal thermal conditions and a single separator container 10, at the division cited above, for the high pressure liquid.

It is understood that the control of the temperature and of the pressure +5° to +10° C. (14 to 20 bars) of the cooling liquid of the head of column 5 permits a monophasic gas to be obtained at the same time at the exit of the cooler 3C and exit (42) of the cold exchanger 9 (at −20° C. to −40° C. approximately, 2.5 to 3.5 bars).

It is to be noted that in practice N exchangers 8 are mounted in parallel and N exchangers 9 in parallel.

Figure 2:
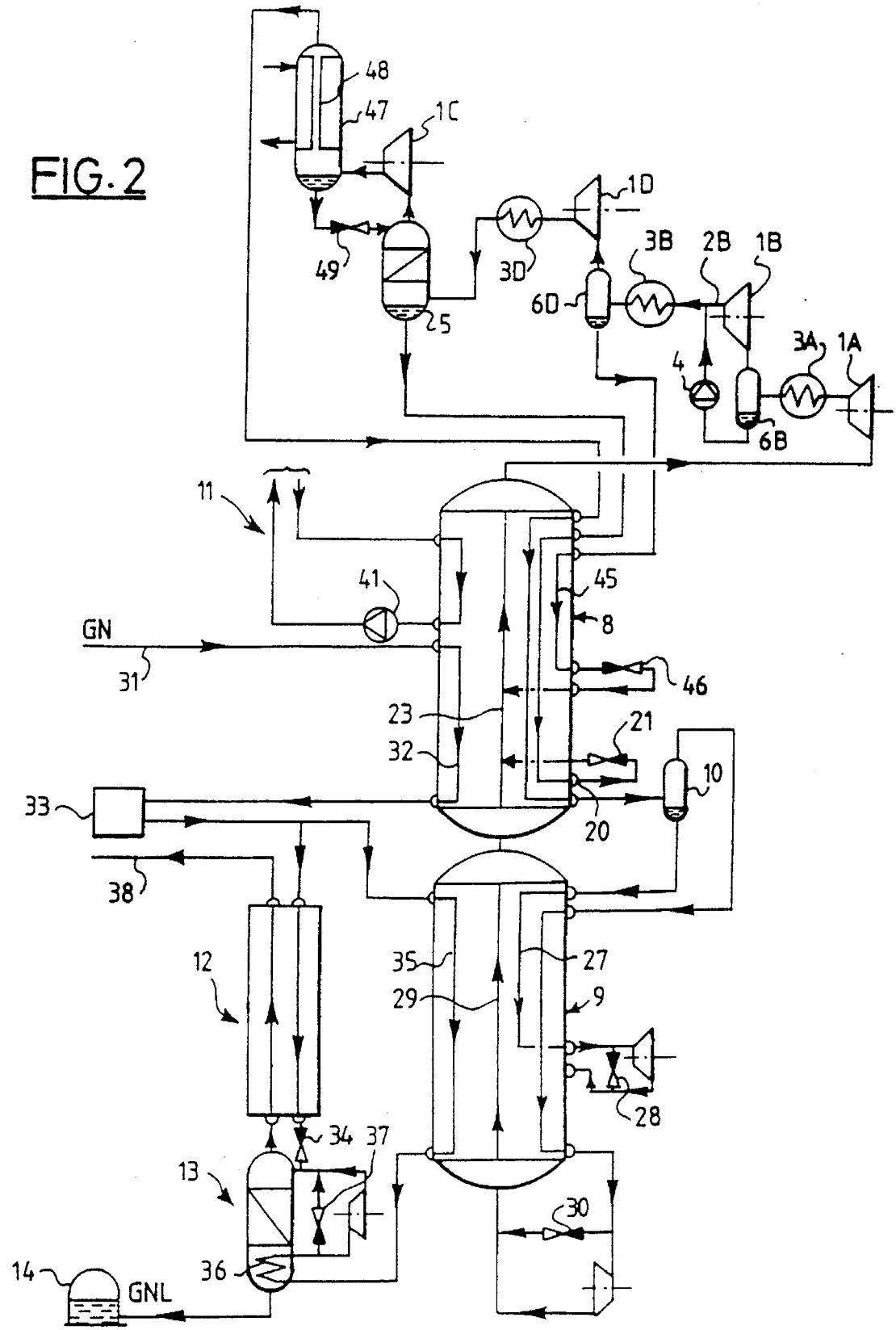
FIG. 2 schematically represents another embodiment of the installation according to the invention.

The installation represented in FIG. 2 only differs from that in FIG. 1 by the addition between the compression stages 1B and 1C, of another intermediate compression stage 1D as well as by the manner in which the return flow liquid in column 5 is cooled.

Thus the cooler 3B leads into a separation container 6D, the vapour phase of which feeds the stage 1D. The output of the latter is cooled by a cooler 3D then introduced to the base of the column 5. The liquid in the container 6D constitutes an additional cooling liquid supercooled in additional ducts 45 provided in the hot part of the exchanger 8, exiting from the latter depressurised to the low pressure at a depressurisation valve 46 and reintroduced into the exchanger to be vaporised in the intermediate part of the low pressure ducts Moreover the head vapour of the column 5 is sent directly to the suction of the last compression stage 1C, and the fluid at high pressure is sent to the base of dephlegmator 47 cooled by a trickle of seawater over vertical tubes 48. The majority of the heavy elements are collected at the base of the dephlegmator, depressurised in a depressurisation valve 49 and introduced as a return flow at the head of column 5, and the head vapour of the dephlegmator forms, as before, the high pressure coolant, which is cooled in passing to the cold end of the exchanger 8 then after separation of the phases in 10, as it passes to the cold end of the exchanger 9.

Figure 3:
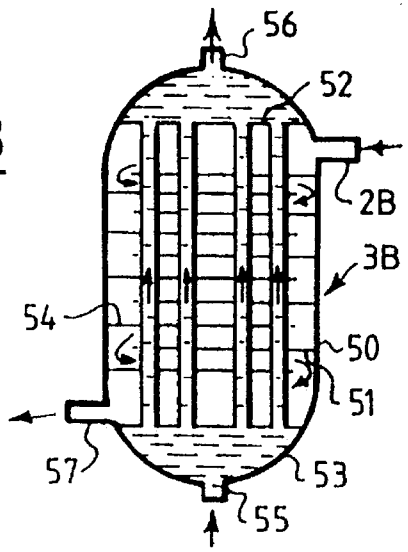
FIG. 3 represents in more detail an element of the installation of FIG. 2.

FIG. 3 represents an embodiment of a heat exchanger capable of being used as an intermediate cooler 3B. This exchanger comprises a grid 50 in which a certain number of vertical tubes 51 open at their two ends extend between an upper plate 52 and a lower plate 53. Between these two plates and on the exterior of the tubes are mounted a certain number of horizontal chicanes 54.

Cooling water arrives, through a lower opening 55 at the plate 53, flows upwards through tubes 51 and is evacuated through an upper channel 56. The diphasic mixture delivered by the conduit 2B enters laterally into the grid under the plate 52 and descends along the chicanes, then exits by the exit conduit 57 of the exchanger, situated a little above the plate 53.

Such equipment allows proper homogenisation of the diphasic mixture during its cooling, and an improvement in the acceleration of the condensation in the second stage of the compressor 1 brought about by the loop comprising the pump 4.

Figure 4:
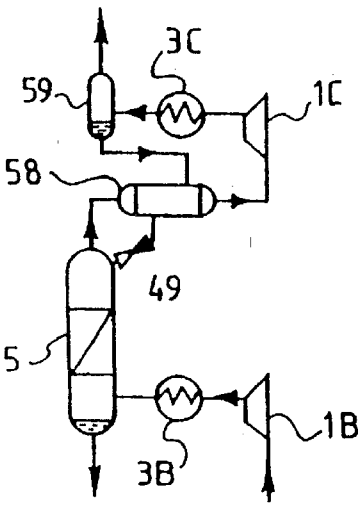
FIG. 4 schematically represents one part of a variation of the installation of FIG. 1.

FIG. 4 represents a further variation of the layout of the distillation column 5. In this variation, the head vapour of the column is reheated by several degrees celsius in an auxiliary heat exchanger 58, then sent to the suction of the last compression stage 1C. The high pressure fluid, after cooling and partial condensation in 3C to the region of +30° to +40° C. is separated into two phases in a separator vessel 59. The vapour issuing from this vessel constitutes the high pressure coolant fluid, whilst the liquid phase, after supercooling by several degrees celsius in the exchanger 58, is depressurised in a depressurisation valve 49 as in FIG. 2 then introduced as a return flow to the head of column 5.

It is to be understood that this variation can be applied to an installation of either three or four compression stages. In addition, the supercooler 58 is optional.

Figure 5:
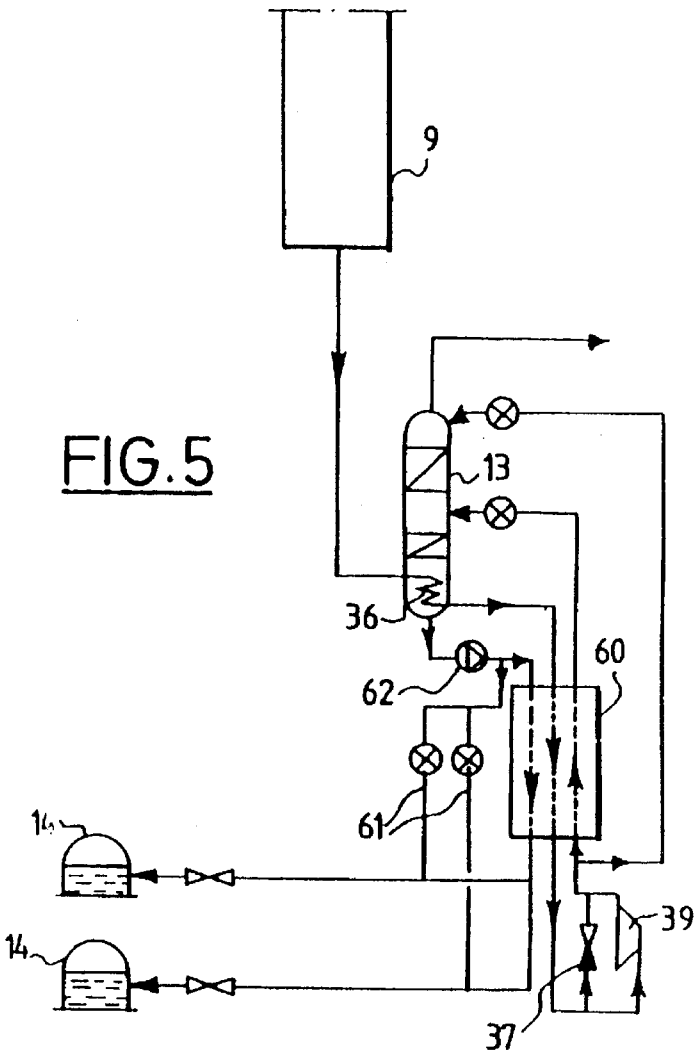
FIG. 5 schematically represents a variant of the cold part of the installation of FIGS. 1 or 2.

Whatever the embodiment under consideration, the de-nitrogenisation column 13 should function in the region of 1.15 bars to 1.2 bars, and consequently the de-nitrogenised LNG exiting from the vessel of this column should be depressurised to atmospheric pressure at the inlet of the store 14, which produces flash gas. This gas as well as gas resulting from heat leaking into the store 14, must then be reclaimed and compressed by an auxiliary compressor in order to be delivered to the "fuel gas" reservoir. FIG. 5 shows an arrangement which permits omission of the auxiliary compressor, in the case where the LNG exiting from the exchanger 9 contains several percent nitrogen.

For this, the LNG exiting from the exchanger 9 is supercooled in the coil 36 of the column 13 and is once again supercooled in an auxiliary heat exchanger 60. The liquid is then depressurised to 1.2 bars in the depressurisation valve 37 and the turbine 39, then divided into two streams: one stream is vaporised in the exchanger 60 and then introduced at an intermediate level into the column 13, and one stream is sent as a return flow to the head of this latter.

The liquid of the column 13, which is LNG without nitrogen is then for each store, divided into two streams one of which is supercooled in the exchanger 60 whilst the other passes into a branch 61 to regulate the overall degree of supercooling, circulation of the liquid being assured by a pump 62.

In this way, it is liquid supercooled to about 2° C. which is delivered to the stores 14, which practically suppresses all flash at the entry of these stores and all evaporation due to the entry of heat with the passage of time. As is understood it is the difference of composition of the LNG before and after de-nitrogenisation which allows such supercooling in the exchanger 60 to be obtained.

In the same way, the head vapour in the column 5 is generally sufficiently rich in methane to be recovered as such for "fuel gas", in the way indicated above. It is thus necessary to provide another auxiliary compressor for this purpose. If, moreover, the compressor cycle 1 is driven by a gas turbine, it is necessary to feed the latter by combustible gas under a pressure of the order of 20 to 25 bars, which leads to the installation of an auxiliary compressor of some power. The arrangement in FIG. 6 shows how the need for such an auxiliary compressor can be avoided.

Figure 6:
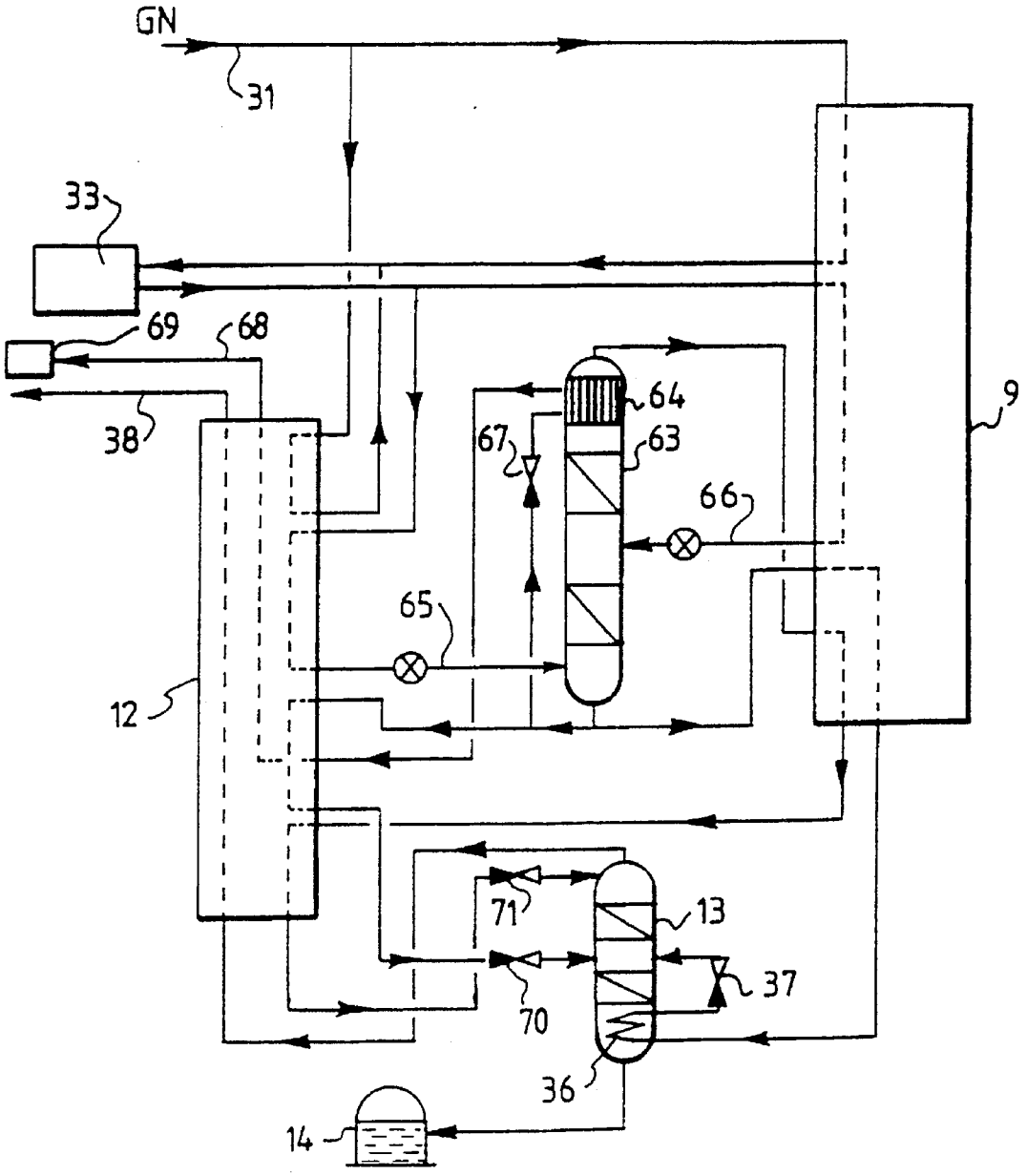
FIG. 6 is a schematic partial view of another variant of the installation according to the invention.

In FIG. 6, a further preliminary de-nitrogenisation column 63 is used under the pressure of natural gas, provided with a head condenser 64.

That part of the natural gas coming from the apparatus 33 which is treated in the exchanger 12 is only cooled there to an intermediate temperature T1, then is introduced into the column 63, via a conduit 65, while the rest of this natural gas is only cooled in the exchanger 9 to an intermediate temperature T2 lower than T1 then introduced at an intermediate level of the same column, via a conduit 66.

The cooling of the condenser 64 is assured by releasing the pressure of a part of the liquid in the column to the region of 25 bars in a depressurisation valve 67. The gas resulting from this vaporisation has the same composition as the liquid in the column, that is to say possesses low grade nitrogen, and thus constitutes a combustible gas below 25 bars which is directly usable, via a conduit 68, in the gas turbine 69.

The rest of the liquid in the column 63 is, after supercooling partly in the cold part of the exchanger 9 and the coil 36 of the column 13, and partly in the cold part of the exchanger 12, depressurised in 37 and 70 respectively and introduced at an intermediate level into the column 13. The head vapour in the column 63, containing 30–35% nitrogen is cooled and condensed in the cold part of the exchanger 9, supercooled in the cold part of the exchanger 12 and after depressurisation at a depressurisation valve 71, introduced as a return flow to the top of column 13.

The nitrogen enrichment of the wash liquid of the column 13 has as a consequence that the nitrogen vapour of this column is sufficiently weak in methane, for example containing 10–15% of methane to be put into the atmosphere via the conduit 38 after reheating in 12.

Thus two residual gases are obtained in total, one of which is rich in methane and under 25 bars and feeds the gas turbine and the other of which at low pressure is weak in methane and is not recovered.

As represented in FIG. 6 a fraction of the natural gas to be treated carried by the conduit 31 can be cooled in the hot part of the exchanger 12 before being sent to the apparatus 33.

I claim:

1. A cooling installation for cooling a fluid, the installation comprising:

a compressor unit for compressing at least a part of a coolant mixture to be used for cooling said fluid;

separating means for obtaining a separation of the pressurized coolant mixture in at least one vapour fraction and at least one liquid fraction; and heat exchanger means comprising at least one plate heat exchanger and including:

a first inlet in fluid communication with the separating means, and a second inlet in fluid communication with an admission conduit for the fluid to be cooled, for circulating and exchanging heat between said fluid to be cooled and at least a part of the pressurized coolant mixture; and a first outlet in fluid communication with a discharge conduit for said fluid after the fluid has circulated in said heat exchanger means, and a second outlet in fluid communication with an inlet of the compressor unit.

2. The cooling installation according to claim 1, wherein the fluid to be cooled is a natural gas to be liquified and the coolant mixture comprises constituents of various volatilities.

3. The cooling installation according to claim 1, wherein the heat exchanger means comprises a first plate heat exchanger and a second plate heat exchanger constituting a hot portion and a cold portion of the heat exchanger means, respectively, said first and second plate heat exchangers being disposed in series and including ends which are butt-jointed, so that at least a part of said pressurized coolant mixture passes directly from one to the other of said first and second plate heat exchangers.

4. The cooling installation according to claim 1, wherein the separating means comprises at least one of a distilling apparatus, a dephlegmator and a separation container.

5. The cooling installation according to claim 4, wherein the separating means further comprises a cooler.

6. A cooling installation for cooling a fluid, the installation comprising:

an integral incorporated cascade cooling circuit in which circulates a coolant mixture to be used for cooling the fluid and comprising volatile constituents, said circuit including:

a compressor unit comprising a plurality of compression stages disposed in series and including at least one intermediate stage of compression and a final stage of compression for compressing at least a part of said coolant mixture;

heat exchanger means comprising at least one plate heat exchanger having:

a first inlet in fluid communication with an outlet of the compressor unit, and a second inlet in fluid communication with an admission conduit for the fluid to be cooled, for circulating and exchanging heat between said fluid and at least a part of the pressurized coolant mixture; and a first outlet in fluid communication with a discharge conduit for said fluid after the fluid has circulated in said at least one plate heat exchanger, and a second outlet in fluid communication with an inlet of the compressor unit.

7. The cooling installation according to claim 6, further comprising:

a distillation apparatus interposed between a penultimate stage of compression and the final stage of compression, said distillation apparatus having an upper part and a lower part, said upper part being in fluid communication with an inlet of said final compression stage;

cooling means for cooling the upper part of said distillation apparatus, said cooling means comprising cooling ducts passing in said heat exchanger means, and a separation container for separating a vapour fraction from a liquid fraction, said separation container having a lower part and an upper part, said lower part of the separation container being in fluid communication with the upper part of the distillation apparatus and the upper part of the separation container being connected to the inlet of the final compression stage.

8. The cooling installation according to claim 6, further comprising separating means which comprises:

a distillation apparatus interposed between a penultimate stage of compression and the final stage of compression, said distillation apparatus having an upper part and a lower part, said upper part being in fluid communication with an inlet of said final compression stage; and cooling ducts in fluid communication with the lower part of the distillation apparatus and in which circulates a liquid issued from said distillation apparatus, said cooling ducts entering through the first inlet for passing in said at least one plate heat exchanger and being further in fluid communication with the second outlet thereof.

9. The cooling installation according to claim 6, wherein the installation further comprises:

separating means including at least one of a distilling apparatus, a dephlegmator, a condenser and a separation container, for obtaining a separation of the pressurized coolant mixture in at least one vapour fraction and at least one liquid fraction; and depressurizing means for expanding said at least one liquid fraction for obtaining a vapour depressurized fraction; and wherein the at least one plate heat exchanger further comprises a third inlet in fluid communication with an outlet of the separating means for sending thereto said at least one liquid fraction and mixing means for mixing, in said at least one plate heat exchanger, said at least a part of the compressed coolant mixture circulating therein with the vapour depressurized fraction.

10. The cooling installation according to claim 9, wherein the separating means is interposed between two successive stages of compression.

11. The cooling installation according to claim 6, further comprising:

a distillation apparatus interposed between a penultimate stage of compression and the final stage of compression, said distillation apparatus having an upper part and a lower part, said upper part being in fluid communication with an inlet of said final compression stage;

fluid condensing and separating means interposed between an outlet of the final compression stage and said heat exchanger means, for cooling the resultant of the final compression stage to a temperature adapted for cooling the upper part of the distillation apparatus and for obtaining a liquid fraction and a vapour fraction; and a depressurization valve interposed between the fluid condensing and separating means and said upper part of the distillation apparatus for expanding said liquid fraction obtained by the fluid condensing and separating means before providing the liquid fraction to said upper part of the distillation apparatus.

12. The installation according to claim 11, further comprising an auxiliary heat exchanger interposed between both said distillation apparatus and the final compression stage and between the fluid condensing and separating means and the depressurization valve, for receiving said liquid fraction of the fluid condensing and separating means and conducting a heat exchange relation between the liquid fraction and a heat vapour fraction issued from the cooled upper part of the distillation apparatus.

13. A cooling installation for cooling a fluid, the installation comprising:

a compressor unit for compressing at least a part of a coolant mixture to be use for cooling said fluid, the cooling mixture comprising volatile constituents; and heat exchanger means comprising a first plate heat exchanger and a second plate heat exchanger, the first and second plate heat exchangers being disposed in series;

both said first and second plate heat exchangers comprising:

first circulation means for circulating into both said plate heat exchangers, successively, at least a part of the pressurized coolant mixture issued from the compressor unit; and second circulation means for circulating into both said heat exchangers, successively, at least a part of said fluid to be cooled in a heat exchange relationship with said at least a part of the pressurized coolant mixture.

14. The installation according to claim 13, further comprising separating means interposed between the compressor unit and the heat exchanger means, for obtaining a separation of the pressurized coolant mixture in at least one vapour fraction and at least one liquid fraction.

15. The installation according to claim 14, wherein:

a) the first circulation means comprises:

first high pressure conduit means for circulating and cooling said at least a part of the pressurized coolant mixture into the first plate heat exchanger and further into at least a portion of the second plate heat exchanger, successively, said first high pressure conduit means including:

an inlet in fluid communication with an outlet of the separating means; and an outlet for the coolant mixture;

second low pressure conduit means including:

an inlet in fluid communication with said outlet of the first high pressure conduit means, for recirculating into the second plate heat exchanger and further into the first plate heat exchanger, at least a part of the coolant mixture issued from the first high pressure conduit means; and an outlet in fluid communication with an inlet of the compressor unit; and depressurizing means for expanding, between the first high pressure conduit means and the second low pressure conduit means, at least a part of the coolant mixture issued from the first high pressure conduit means; and (b) the second circulation means comprises third conduit means for circulating and cooling the fluid to be cooled into said first and second plate heat exchangers, successively.

16. The installation according to claim 13, wherein the first and second plate heat exchangers are butt-jointed, so that said at least a part of the pressurized coolant mixture circulating in the first circulation means passes directly from one to the other of said first and second plate heat exchangers.

17. The installation according to claim 15, wherein the depressurizing means comprises an expander in which circulates a part of the coolant mixture issued from the first high pressure conduit means and to be depressurized before being recirculated in the second low pressure conduit means.

18. The installation according to claim 15, wherein a separation vessel is disposed between said first and second plate heat exchangers, externally thereto.

19. The cooling installation according to claim 15, wherein the fluid to be cooled is a natural gas to be liquified and the coolant mixture comprises constituents of various volatilities.

20. A cooling installation for cooling a fluid, the installation comprising:

a compressor unit for compressing at least a part of a coolant mixture to be used for cooling said fluid and comprising volatile constituents;

separating means for obtaining a separation of the pressurized coolant mixture in at least one vapour fraction and at least one liquid fraction; and heat exchanger means comprising a first plate heat exchanger and a second plate heat exchanger, the first and second plate heat exchangers being disposed in series and comprising:

first circulation means for circulating therein at least a part of the pressurized coolant mixture issued from the separating means; and second circulation means for circulating at least a part of said fluid to be cooled in a heat exchange relationship with said at least a part of the pressurized coolant mixture;

said first and second plate heat exchangers having an axial length, the first plate heat exchanger comprising first and second domes at two opposite axial ends thereof, and the second plate heat exchanger comprising third and fourth domes at two opposite axial ends thereof;

said first and second circulation means extending essentially parallel to the axial length of the first and second plate heat exchangers; and the first circulation means comprising ducts leading into the second dome of the first plate heat exchanger and communicating directly with the third dome of the second plate heat exchanger disposed in front of said second dome.

21. The installation according to claim 20, wherein the first and second plate heat exchangers are butt-jointed by their second and third domes, respectively, so that said at least a part of the pressurized coolant mixture circulating in the first circulation means passes directly from one to the other of said first and second plate heat exchangers.

22. A cooling installation for cooling a fluid, the installation comprising:

a compressor unit for compressing at least a part of a coolant mixture to be used for cooling said fluid; and heat exchanger means comprising a first plate heat exchanger and a second plate heat exchanger, said first and second plate heat exchangers being disposed in series and including ends which are butt-jointed, so that at least a part of the coolant mixture passes directly from said second plate heat exchanger to said first plate heat exchanger.

23. The cooling installation according to claim 22, wherein the fluid to be cooled is a natural gas to be liquified and the coolant mixture comprises constituents of various volatilities.

24. A cooling installation for cooling a fluid, the installation comprising:

a compressor unit for compressing at least a part of a coolant mixture to be used for cooling said fluid; and heat exchanger means comprising a first plate heat exchanger and a second plate heat exchanger, said first and second plate heat exchangers having a vertical axis and being disposed vertically in series, the first plate heat exchanger being situated above the second plate heat exchanger.

25. The installation according to claim 24, wherein the first and the second plate heat exchangers are metallic and have substantially the same length along the vertical axes thereof.

26. A fluid cooling process for cooling a fluid, the process comprising steps of:

compressing in a compressor unit a cooling mixture comprising constituents of various volatilities;

obtaining a separation of at least a part of the compressed cooling mixture in at least one vapour fraction and at least one liquid fraction;

circulating at least some of said liquid fraction and vapour fraction into at least one plate heat exchanger of a heat exchange line, for obtaining a cooled resultant;

expanding said cooled resultant;

recirculating the expanded cooled resultant into said at least one plate heat exchanger;

sending the recirculated expanded cooled resultant to an admission of the compressor unit; and circulating the fluid to be cooled into said at least one plate heat exchanger, in a heat exchange relationship with at least some of said circulating fractions and recirculating resultant.

27. The method according to claim 26, wherein the fluid to be cooled is a dried natural gas, and the method further comprises steps of:

circulating into the heat exchange line the natural gas before the gas has dried;

drying the natural gas having been circulated in said heat exchange line; and recirculating the dried natural gas in the heat exchange line, by passing the dried natural gas through said at least one plate heat exchanger.

28. The process according to claim 26, wherein the step of obtaining the separation of at least a part of the compressed cooling mixture comprises at least one of the steps of distilling, separating in a dephlegmator, partially condensing, and separating in a separation container said at least a part of the compressed cooling mixture.

29. A fluid cooling process according to claim 26, wherein:

the step of compressing the cooling mixture comprises the step of compressing said cooling mixture in a penultimate compression stage among a plurality of compression stages; and the step of obtaining a separation of at least a part of the compressed cooling mixture comprises steps of:

partially condensing the cooling mixture issued from said penultimate stage of compression to obtain a first liquid fraction and a first vapour fraction, said fractions having a determined temperature;

distilling at least the first vapour fraction in a distillation apparatus comprising a head upper part and a lower part, while cooling said head upper part of the distillation apparatus with a cooling fluid having a temperature lower than said determined temperature of at least said first vapour fraction and obtaining a distillator head vapour fraction and a distillator liquid fraction;

sending said distillator head vapour fraction towards a final high compression stage of said plurality of compression stages, and obtaining a high pressure vapour fraction; and sending to said at least one plate heat exchanger at least some of said first liquid fraction, said distillator liquid fraction and said high pressure vapour fraction.

30. A fluid cooling process for cooling a fluid, the process comprising steps of:

compressing in a compressor unit a cooling mixture comprising constituents of various volatilities;

obtaining a separation of at least a part of the compressed cooling mixture in at least one vapour fraction and at least one liquid fraction;

circulating at least a part of said at least one vapour fraction and said at least one liquid fraction into a first plate heat exchanger, for obtaining a cooled resultant;

circulating said cooled resultant into a second plate heat exchanger, for obtaining a super-cooled resultant;

expanding the super-cooled resultant;

recirculating said expanded super-cooled resultant into the second plate heat exchanger and thereafter into the first plate heat exchanger, for obtaining a recirculated vapour resultant;

sending said recirculated vapour resultant to an admission of the compressor unit; and circulating the fluid to be cooled into the first plate heat exchanger and thereafter into the second plate heat exchanger, in a heat exchange relationship with said circulating and recirculating resultants.

31. The process according to claim 30, wherein the step of obtaining the separation of at least a part of the compressed cooling mixture comprises at least one of the steps of distilling, separating in a dephlegmator, partially condensing, and separating in a separation container said at least a part of the cooling mixture.

32. The process according to claim 30, wherein the step of recirculating the expanded super-cooled resultant comprises steps of:

butt-joining the first and the second plate heat exchangers; and passing said recirculating resultant directly from the second plate heat exchanger to the first plate heat exchanger.

33. The process according to claim 32, wherein the step of passing said recirculating resultant is free of any diphasic redistribution between the second and first plate heat exchangers.

34. The method according to claim 30, wherein the fluid to be cooled is a natural gas and the step of circulating the fluid to be cooled into said first and second plate heat exchangers comprises the further steps of eliminating C2 to C5 hydrocarbons of the natural gas issued from the first plate heat exchanger and sending a portion of said partially decarbonated natural gas to the second plate heat exchanger.

35. A fluid cooling process for cooling a fluid, the process comprising steps of:

compressing in a compressor unit a cooling mixture comprising constituents of various volatilities;

obtaining a separation of at least a part of the compressed cooling mixture in at least one vapour fraction and at least one liquid fraction;

circulating said at least one liquid fraction into a first plate heat exchanger, for obtaining a first resultant;

expanding said first resultant;

circulating said at least one vapour fraction into the first plate heat exchanger, for obtaining a second resultant;

circulating the second resultant into a second plate heat exchanger for obtaining a third resultant;

depressurizing said third resultant;

recirculating said depressurized third resultant into the second plate heat exchanger and thereafter into the first plate heat exchanger;

mixing in the first plate heat exchanger the recirculating depressurized third resultant with the expanded first resultant, for obtaining a vapour fourth resultant;

sending said vapour fourth resultant to an admission of the compressor unit; and circulating the fluid to be cooled into the first plate heat exchanger and thereafter into the second plate heat exchanger, in a heat exchange relationship with said circulating and recirculating resultants.

36. The process according to claim 35, wherein the step of obtaining the separation of at least a part of the compressed cooling mixture comprises at least one of the steps of distilling, separating in a dephlegmator, partially condensing, and separating in a separation container said at least a part of the cooling mixture.

37. A fluid cooling process for cooling a fluid, the process comprising the steps of:

compressing in a compressor unit a cooling mixture comprising constituents of various volatilities;

obtaining a separation of at least a part of the compressed cooling mixture in at least one vapour fraction and at least one liquid fraction;

circulating said at least one vapour fraction and said at least one liquid fraction into first and second plate heat exchangers disposed in series, and expanding said at least one vapour fraction and said at least one liquid fraction, for obtaining a vapour resultant;

sending the vapour resultant to an admission of the compressor unit; and circulating the fluid to be cooled into said first and second plate heat exchangers, in a heat exchange relationship with said at least one vapour and liquid fractions circulating in said first and second plate heat exchangers.

38. The method according to claim 37, wherein the step of circulating and expanding said at least one vapour fraction and said at least one liquid fraction into the first and second heat exchangers comprises steps of:

butt-joining the first and the second plate heat exchangers;

circulating said at least one liquid fraction in the first plate heat exchanger and thereafter in the second plate heat exchanger, for obtaining a resultant;

expanding and recirculating the resultant in the second plate heat exchanger;

passing the recirculating resultant directly from the second plate heat exchanger through said butt-joining and to the first plate heat exchanger, for obtaining said vapour resultant.

39. The process according to claim 38, wherein the step of passing the recirculating resultant is free of any diphasic redistribution between the second and first plate heat exchangers.

40. The method according to claim 37, wherein the fluid to be cooled is a natural gas to be liquified.

* * * * *

UNITED STATES PATENT AND TRADEMARK OFFICE

CERTIFICATE OF CORRECTION

PATENT NO. : 5,613,373

DATED : March 25, 1997

INVENTOR(S) : MAURICE GRENIER

It is certified that error appears in the above-identified patent and that said Letters Patent is hereby corrected as shown below:

IN THE CLAIMS

The following claims were omitted from the patent and should read as follows:

41. The installation according to claim 1, wherein:

the compressor unit comprises at least two stages of compression including a penultimate stage of compression and a final stage of compression;

the separating means comprise a distillation apparatus disposed between the penultimate stage of compression and the final stage of compression; and the installation further comprises a cooler disposed between an outlet of the penultimate stage of compression and an inlet for the coolant mixture of the distillation apparatus, for partially condensing the coolant mixture at a predetermined temperature.

UNITED STATES PATENT AND TRADEMARK OFFICE

CERTIFICATE OF CORRECTION

DATED : March 25, 1997

INVENTOR(S) : MAURICE GRENIER

It is certified that error appears in the above-identified patent and that said Letters Patent is hereby corrected as shown below:

IN THE CLAIMS (continued)

42. The installation according to claim 1, wherein:

the compressor unit comprises at least two stages of compression including a penultimate stage of compression and a final stage of compression;

the penultimate stage of compression comprises a cooler for partially condensing the coolant mixture at a predetermined temperature;

the separating means comprise a distillation apparatus disposed between the penultimate stage of compression and the final stage of compression, the distillation apparatus comprising an upper part, and wherein:

the installation further comprises a cooling means for cooling the upper part of the distillation apparatus with a liquid having a temperature lower than said predetermined temperature.

UNITED STATES PATENT AND TRADEMARK OFFICE

CERTIFICATE OF CORRECTION

DATED : March 25, 1997

INVENTOR(S) : MAURICE GRENIER

It is certified that error appears in the above-identified patent and that said Letters Patent is hereby corrected as shown below:

IN THE CLAIMS (continued)

43. An installation according to claim 42, wherein the cooling means comprise:

cooling ducts connected to an outlet for vapour of the distillation apparatus and passing through said at least one plate heat exchanger for partially condensing said vapour issued from the distillation apparatus, and obtaining a condensed resultant; and a separation container for separating said condensed resultant into a vapour fraction and a liquid fraction, the separation container having a lower part and an upper part, the lower part of the separation container being in fluid communication with the upper part of the distillation apparatus and the upper part of the separation container being connected to the inlet of the final compression stage.

It is certified that error appears in the above-identified patent and that said Letters Patent is hereby corrected as shown below:

IN THE CLAIMS (continued)

44. An installation according to claim 42, wherein the cooling means comprise:

fluid condensing and separating means interposed between the outlet of the final compression stage and said at least one plate heat exchanger, for cooling the resultant of the final compression stage to substantially said cooling temperature, and for obtaining a liquid fraction and a vapour fraction; and a depressurising valve interposed between the fluid condensing and separating means and the upper part of the distillation apparatus, for depressurising the liquid fraction issued from the fluid condensing and separating means before providing the liquid fraction to the upper part of the distillation apparatus.

UNITED STATES PATENT AND TRADEMARK OFFICE

CERTIFICATE OF CORRECTION

DATED : March 25, 1997

INVENTOR(S) : MAURICE GRENIER

It is certified that error appears in the above-identified patent and that said Letters Patent is hereby corrected as shown below:

IN THE CLAIMS (continued)

45. An installation according to claim 44, further comprising an auxiliary heat exchanger interposed between both said distillation apparatus and said final compression stage and between said fluid condensing and separating means and said depressurization valve, for receiving said liquid fraction of the fluid condensing and separating means and conducting a heat exchange between the liquid fraction and a head vapour issued from said cooled upper part of the distillation apparatus.

UNITED STATES PATENT AND TRADEMARK OFFICE

CERTIFICATE OF CORRECTION

DATED : March 25, 1997

INVENTOR(S) : MAURICE GRENIER

It is certified that error appears in the above-identified patent and that said Letters Patent is hereby corrected as shown below:

IN THE CLAIMS (continued)

46. An installation according to claim 45, wherein the fluid condensing and separating means comprise successively a cooler, for cooling and partially condensing the resultant issued from the final compression stage, and a separation container adapted for separating said partially condensed resultant into said liquid fraction and said vapour fraction which is sent to the heat exchanger means.

UNITED STATES PATENT AND TRADEMARK OFFICE

CERTIFICATE OF CORRECTION

DATED : March 25, 1997

INVENTOR(S) : MAURICE GRENIER

It is certified that error appears in the above-identified patent and that said Letters Patent is hereby corrected as shown below:

IN THE CLAIMS (continued)

47. The method according to claim 46, wherein:

the step of compressing the cooling mixture comprises the step of compressing said cooling mixture in a penultimate compression stage among a plurality of compression stages; and the step of obtaining a separation of at least a part of the compressed cooling mixture comprises steps of:

partially condensing the cooling mixture issued from said penultimate stage of compression, in a heat exchange relationship with a cooling fluid having a determined temperature, for obtaining a partially condensed cooling mixture;

UNITED STATES PATENT AND TRADEMARK OFFICE

CERTIFICATE OF CORRECTION

PATENT NO. : 5,613,373

DATED : March 25, 1997

INVENTOR(S) : MAURICE GRENIER

It is certified that error appears in the above-identified patent and that said Letters Patent is hereby corrected as shown below:

IN THE CLAIMS (continued)

Claim 47 (continued)

distilling said partially condensed cooling mixture in a distillation apparatus comprising a head upper part and lower part, while cooling said head upper part of the distillation apparatus with a cooling liquid having a temperature lower than said determined temperature and obtaining a distillator head vapour fraction and a distillator liquid fraction;

sending said distillator head vapour fraction towards a final high compression stage of said plurality of compression stages and obtaining a high pressure vapour fraction; and sending to said at least one plate heat exchanger at least some of said distillator liquid fraction and said high pressure vapour fraction.

Signed and Sealed this

First Day of December, 1998

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,613,373

DATED : March 25, 1997

INVENTOR(S) : Maurice Grenier

It is certified that error appears in the above-identified patent and that said Letters Patent is hereby corrected as shown below:

Claim 47 should read as shown below:

47. The method according to claim 26, wherein:

the step of compressing the cooling mixture comprises the step of compressing said cooling mixture in a penultimate compression stage among a plurality of compression stages; and the step of obtaining a separation of at least a part of the compressed cooling mixture comprises steps of:

partially condensing the cooling mixture issued from said penultimate stage of compression, in a heat exchange relationship with a cooling fluid having a determined temperature, for obtaining a partially condensed cooling mixture;

distilling said partially condensed cooling mixture in a distillation apparatus comprising a head upper part and lower part, while cooling said head upper part of the distillation apparatus with a cooling liquid having a temperature lower than said determined temperature and obtaining a distiller head vapour fraction and a distillator liquid fraction;

sending said distillator head vapour fraction towards a final high compression stage of said plurality of compression stages and obtaining a high pressure vapour fraction; and sending to said at least one plate heat exchanger at least some of said distillator liquid fraction and said high pressure vapour fraction.

Signed and Sealed this

Thirty-first Day of October, 2000

*Attest:*

Q. TODD DICKINSON

*Attesting Officer*

*Director of Patents and Trademarks*